US006394702B2

(12) United States Patent
Fisher

(10) Patent No.: US 6,394,702 B2
(45) Date of Patent: May 28, 2002

(54) EMERGENCY DUMP APPARATUS FOR BUOYANCY AIR TANKS ON BUOYANT RISER SYSTEMS

(75) Inventor: Edmund A. Fisher, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/915,011

(22) Filed: Jul. 25, 2001

Related U.S. Application Data

(62) Division of application No. 09/753,348, filed on Jan. 2, 2001, now Pat. No. 6,296,421, which is a division of application No. 09/339,630, filed on Jun. 24, 1999, now Pat. No. 6,193,441.

(51) Int. Cl.[7] ..... E21B 17/01

(52) U.S. Cl. ..... 405/224.4; 405/224.2; 405/211; 166/350; 166/364

(58) Field of Search ..... 405/223.1, 224.2, 405/224.4, 211, 195.1; 166/350, 359, 364, 365, 367

(56) References Cited

U.S. PATENT DOCUMENTS 3,855,656 A * 12/1974 Blenkarn ..... 166/350 X

* cited by examiner

*Primary Examiner*—Heather Shackelford
*Assistant Examiner*—Sunil Singh
(74) *Attorney, Agent, or Firm*—Jackie Lee Duke

(57) ABSTRACT

An apparatus for rapid venting of the compressed air and deballasting of a buoyant air tank in a positively buoyant riser system in the event of a premature drive off or a riser section parting is shown. The buoyancy tank or housing includes an annularly shaped flange positioned on its upper end and retained by explosive bolts. The inner circumference of the flange is sealed to the riser section supported by the buoyancy housing. A sensing means, activated by a parting of the riser, actuates the explosive bolts to release the annularly shaped flange and flood the buoyancy housing while restraining lines limit movement of the buoyancy housing with respect to the riser section.

4 Claims, 5 Drawing Sheets

EMERGENCY DUMP APPARATUS FOR BUOYANCY AIR TANKS ON BUOYANT RISER SYSTEMS

This is a divisional application of application Ser. No. 09/753,348 filed Jan. 2, 2001, now U.S. Pat. No. 6,296,421, hereby incorporated herein by reference; which is a divisional application of application Ser. No. 09/339,630 filed Jun. 24, 1999, now U.S. Pat. No. 6,193,441, hereby incorporated herein by reference.

BACKGROUND OF THE INVENTION

1. Field of the Invention

This invention relates to a novel apparatus for quickly releasing the air from buoyancy tanks or housings in those situations when a quick deballasting of the buoyancy tanks or housings is required. A typical situation where this might occur is the case of a free-standing drilling riser that replaces most of the rig tension with positive buoyancy provided by buoyancy tanks or housings mounted on the riser sections. In the event of a catastrophic riser failure, i.e., where the riser below the buoyancy tanks or housings has parted or a bottom release in a dynamically positioned vessel drive off, the positively buoyant riser sections with attached buoyancy tanks or housings would ascend to the surface with increasing velocity to impact the drilling rig's or ship's hull with sufficient force to seriously damage the drilling rig. In the extreme case, the impact of the riser and buoyancy tank or buoyancy housing could sufficiently damage the drilling rig or ship to cause it to sink and lives to be lost.

The use of such positively buoyant risers with buoyancy tanks or housings providing the buoyancy is well known to those of ordinary skill in the art. Typical use dictates several riser sections will have buoyancy tanks or housings attached, depending on the water depth, to leave the riser disconnected and free standing or at least minimize the load on the rig's tensioner system while connected. The buoyancy tanks or housings are usually constructed with an open lower end to facilitate filling of the buoyancy tanks or housings by compressed air or other suitable gas. The volume and pressure of the supplied compressed air is determined by the water depth in which the buoyancy tanks or housings are to be used. Various methods of filling the buoyancy tank or housings either individually or in groups are well known to those of ordinary skill in the art.

Once the riser sections with attached buoyancy tanks or housings are in place the present invention has particular applicability. In the event the riser should fail as noted above, a particularly hazardous situation is presented by the positively buoyant tanks or housings. The present invention minimizes this hazardous situation by allowing a means to vent or deballast the buoyancy tank or housings in a few seconds. It is the rapid venting or deballasting of these buoyancy tanks or housings to which the present invention most closely applies.

2. Description of Related Art

A marine riser with open bottom air cans is shown in U.S. Pat. No. 4,099,560 (Fischer et al.) The apparatus shown by Fischer et al. discloses an air dump valve attached to a tether line that is activated in the event of the riser parting.

U.S. Pat. No. 4,176,986 to Taft et al. discloses another type of riser system with buoyancy tanks attached. A dump valve for rapidly venting the compressed air and controlled by a pilot valve assembly is shown.

Another marine riser with buoyancy system is disclosed in U.S. Pat. No. 4,422,801 (Hale et al.) The system shown by Hale et al. uses a quarter turn ball valve actuated by a trigger cable and air cylinder to vent the buoyancy air tanks.

U.S. Pat. No. 4,646,840 to Bartholomew et al., owned by the assignee of the current invention, discloses a buoyancy tank or housing system with a cascading system for supplying air to the buoyancy tank or housings.

All these systems are too slow for a dynamically positioned vessel that must vent in less than thirty seconds to avoid damage to the drilling vessel.

SUMMARY OF THE INVENTION

The current invention uses a frangible joint or connection to allow for rapid venting of the compressed air and deballasting of a buoyancy tank or housing in a positively buoyant riser system in the event of a riser section parting. The rapid venting of the compressed air ensures that the riser section cannot rapidly ascend to the surface and damage the drill rig positioned above.

According to the present invention, in a first embodiment of the invention, the buoyancy tank or housing includes a circumferentially shaped channel positioned on its upper face. An annularly shaped cover plate is placed over the circumferentially shaped channel and sealed in place by a frangible weld. The annularly shaped cover plate includes a ring positioned on its lower face to which a tether line is anchored. The tether line extends downwardly to similarly positioned rings on the subsequent riser sections and buoyancy tanks or housings. The tether line extends from the lowermost buoyancy tank or housing and is anchored on the BOP stack below. In the event of a catastrophic parting of the riser, as the riser sections and attached buoyancy tanks or housings begin ascending, the tether line is drawn tight. Further ascension of the buoyancy tanks or housings, causes the frangible weld joints to break and peel back the cover plate, exposing the circumferentially shaped channels. This causes an immediate and complete venting of the buoyancy tanks or housings, rendering them negatively buoyant.

In a second embodiment of the invention, the buoyancy tank or housing includes an annularly shaped flange positioned on the top. The annularly shaped flange has a weld joint on its interior and a seal on its exterior to seal against the riser sections and buoyancy tank or housing, respectively. The flange is retained by a plurality of toggle retainer clamps. The toggle retainer clamps are connected to a tether line that extends from the lowermost buoyancy tank or housing and is anchored on the BOP stack below. In the event of a catastrophic parting of the riser, the parting of the riser causes the tether line to release frangible retainer pins holding the toggle retainer clamps thereby releasing the annularly shaped flange from the buoyancy housing. This causes an immediate and complete venting of the buoyancy tanks or housings, rendering them negatively buoyant.

In a third embodiment of the invention, the buoyancy tank or housing includes an annularly shaped flange positioned on the top. The annularly shaped flange has a weld joint on its interior and a seal on its exterior to seal against the riser sections and buoyancy tank or housing, respectively. The flange is retained by a plurality of retainer pin assemblies. The retainer pin assemblies are connected to a tether line that extends from the lowermost buoyancy tank or housing and is anchored on the BOP stack below. In the event of a catastrophic parting of the riser, the parting of the riser causes the tether line to release removable retainer pins thereby releasing the annularly shaped flange from the buoyancy tank or housing. This causes an immediate and complete venting of the buoyancy tanks or housings, rendering them negatively buoyant.

In a fourth embodiment of the invention, the buoyancy tank or housing includes an annularly shaped flange positioned on the top. The annularly shaped flange has a weld joint on its interior and a seal on its exterior to seal against the riser sections and buoyancy tank or housing, respectively. The flange is retained by a plurality of explosive bolt assemblies. The explosive bolt assemblies are connected to a transceiver box connected to the explosive bolt assemblies. In the event of a catastrophic parting of the riser, a signal is transmitted to the transceiver box that in turns fires the explosive bolt assemblies. The release of the explosive bolt assemblies allows the annularly shaped flange to be released from the buoyancy tank or housing. This causes an immediate and complete venting of the buoyancy tanks or housings, rendering them negatively buoyant.

A principal object of the present invention is to provide an apparatus to quickly vent the air from buoyancy tanks or housings thereby preventing their uncontrolled and rapid ascension to the surface.

Another object of the present invention is to provide an apparatus to quickly vent the air from buoyancy tanks or housings without requiring any operator intervention in the event the riser parts.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PRESENTLY PREFERRED EMBODIMENTS

Figure 1:
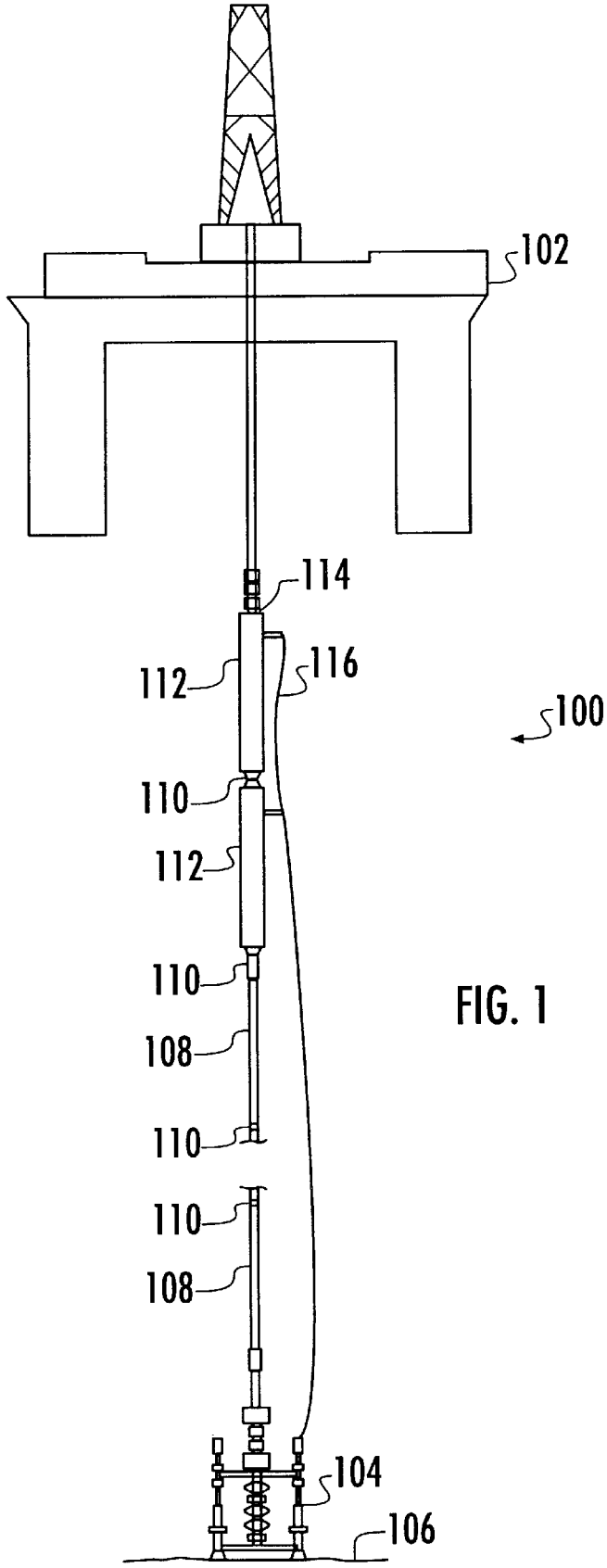
FIG. 1 is an elevation view of a riser system with buoyancy tank or housings used in subsea oil and gas drilling operations that incorporates the emergency dump apparatus of the present invention

With reference to the drawings, and particularly to FIG. 1, subsea drilling riser system 100 is shown in an elevation view. Subsea drilling riser system 100 extends from floating drilling rig or vessel 102 to BOP stack 104 located on ocean floor 106. Subsea drilling riser system 100 is composed of a plurality of riser sections 108 connected in end to end relationship by suitable mechanical means as end connections 110 which may be threaded connections, flanged end connections or clamp hub connections as is well known to those of ordinary skill in the art. Some of riser sections 108 have buoyancy tank or housings 112 clamped thereon or they may be integrally formed therewith without departing from the scope of the invention. Buoyancy tank or housings 112 air filled with compressed air to provide buoyancy to subsea drilling riser system 100 thereby lessening or obviating the need for a riser tensioner system. Upper riser connector 114 is provided near the upper end of riser system 100 to allow drilling rig 102 to disconnect from riser system 100 in the event of a drive off or inclement weather that necessitates the suspension of drilling operations. Tether line 116, of suitable material as chain, wire or polyester rope, extends from buoyancy tank or housings 112 to BOP stack 104 below the lower marine riser package where it is anchored for purposes that will be explained hereinafter.

Figure 2:
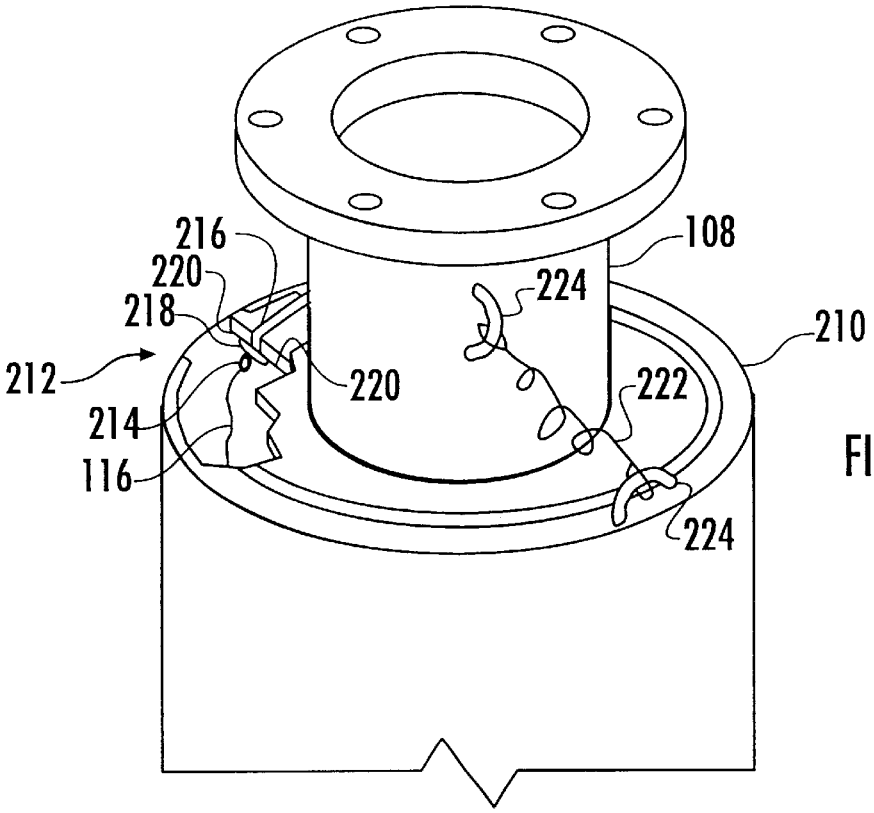
FIG. 2 is an isometric view of the first embodiment of the emergency dump apparatus prior to being activated.
Figure 3:
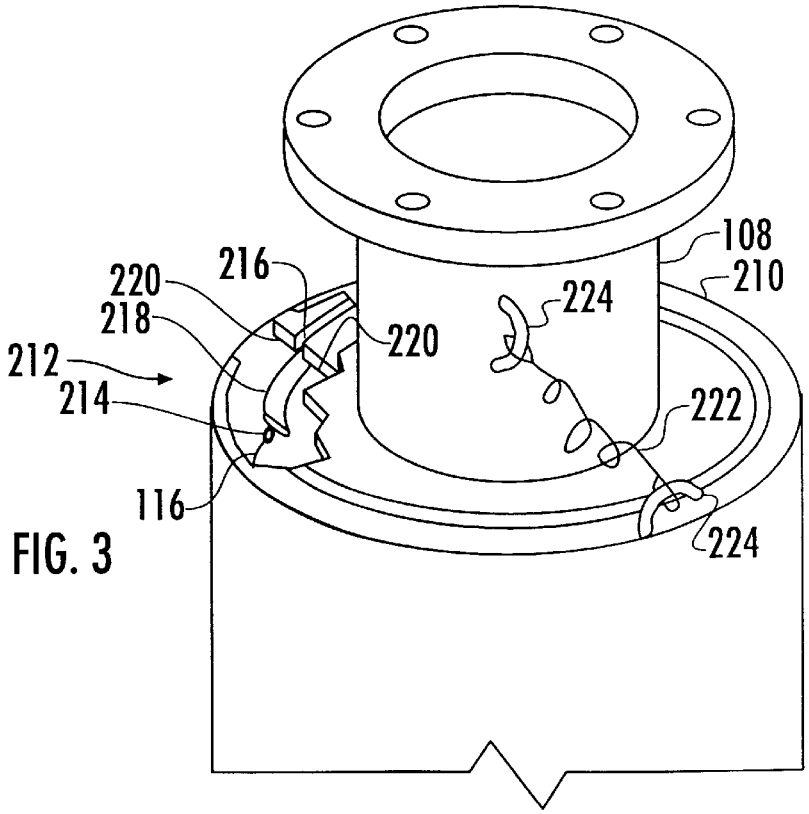
FIG. 3 is an isometric view of the first embodiment of the emergency dump apparatus after activation.

As best seen in FIGS. 2 and 3, the first embodiment of the present invention includes buoyancy tank or housing 210 attached to riser section 108. Buoyancy tank or housing 210 includes frangible section 212 to which actuation ring 214 is attached. Tether line 116 is connected to actuation ring 214 and extends downwardly to BOP stack 104 as previously noted. Frangible section 212 includes circumferentially shaped channel 216 in buoyancy tank or housing 210 that is sealed by annularly shaped ring 218.

Annularly shaped ring 218 is sealed by frangible welded joint 220. Annularly shaped ring 218 extends circumferentially around buoyancy tank or housing 210 and is sealed completely around its periphery by frangible welded joint 220. Frangible welded joint 220 is sized to break when a suitable predetermined force is applied by tether line 116. Restraining line 222 extends between buoyancy tank or housing 210 and riser section 108 and connects to restraining hoops 224 that are welded to buoyancy tank 210 and riser section 108. In the event of a catastrophic riser failure, i.e., where the riser below the buoyancy tanks or housings has parted, the positively buoyant riser sections 108 with attached buoyancy tank or housings 210 will ascend to the surface with increasing velocity unless the compressed air in buoyancy tank or housings 210 is vented immediately. As positively buoyant riser sections 108 with attached buoyancy tank or housings 210 start to ascend toward the surface, tether line 116 is drawn taut and begins pulling on actuation ring 214. As best seen in FIG. 3, continued ascent of riser sections 108 with attached buoyancy tank or housings 210 causes frangible welded joint 220 to break and peel annularly shaped ring 218 from buoyancy tank or housings 210. This detachment of annularly shaped ring 218 leaves circumferentially shaped channel 216 open to sea water and thereby venting the compressed air from buoyancy tank or housings 210 and rendering riser sections 108 negatively buoyant. Restraining line 222 ensures that buoyancy tank or housing 210 does not completely separate from riser section 108 and thereby aids in salvage operations.

Figure 4:
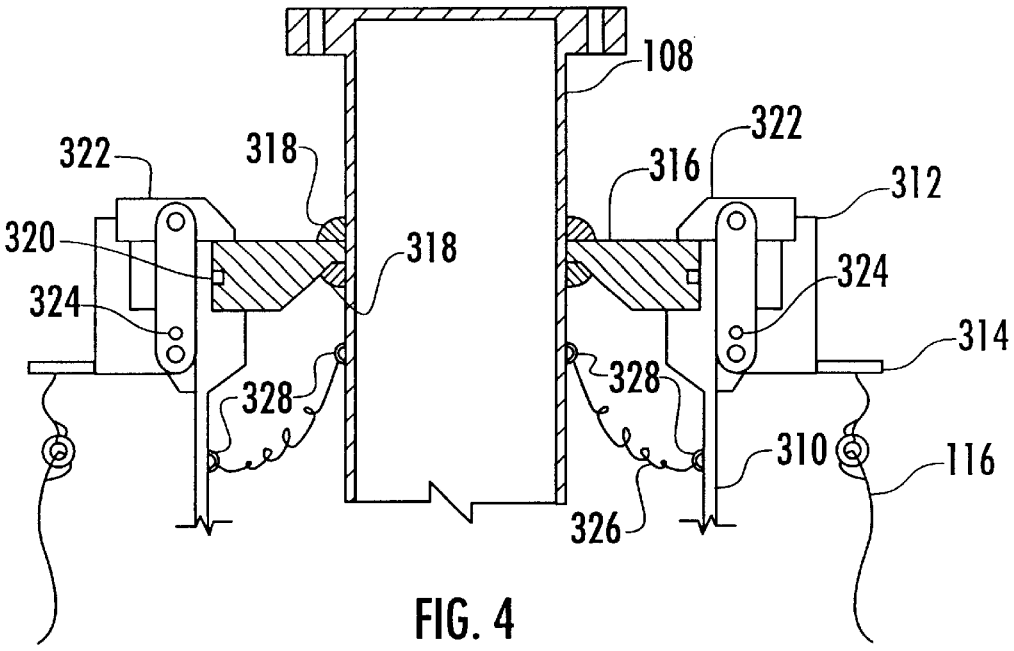
FIG. 4 is a sectional view of the second embodiment of the emergency dump apparatus prior to being activated.
Figure 5:
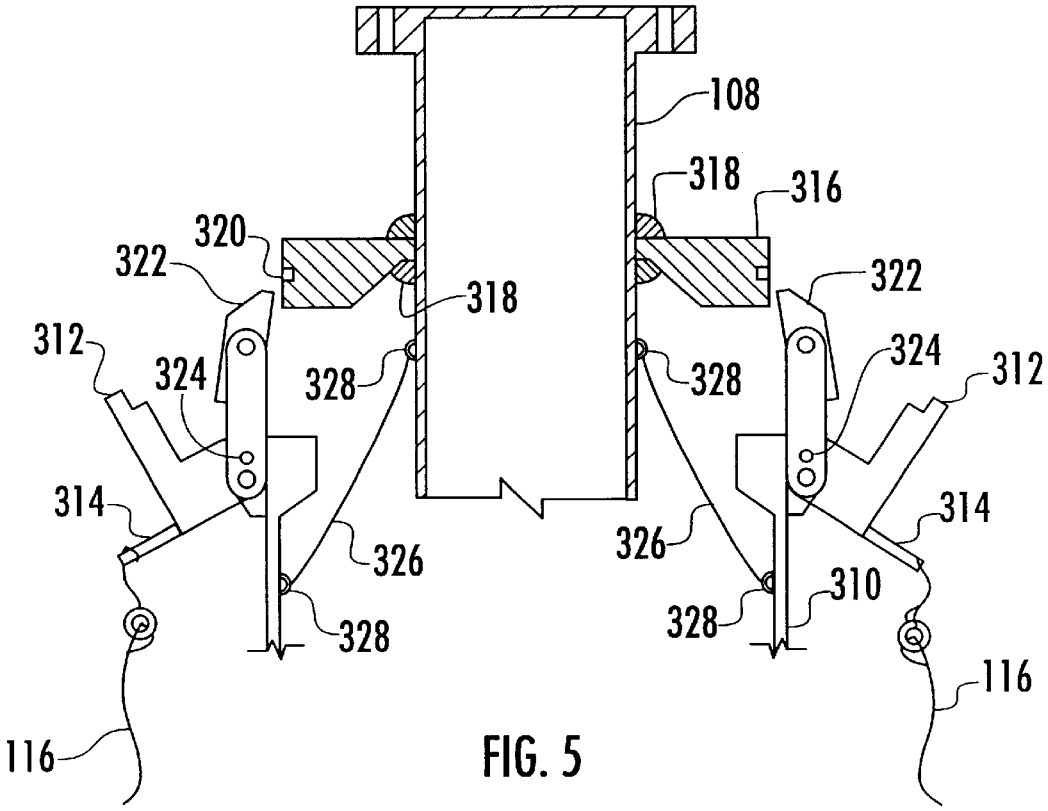
FIG. 5 is a sectional view of the second embodiment of the emergency dump apparatus after activation.

A second embodiment of the present invention is shown in FIGS. 4 and 5. Those items that are the same as in the first embodiment retain the same numeric designation. As in the first embodiment, riser section 108 has buoyancy tank or housing 310 attached thereto. Buoyancy tank or housing 310 has toggle clamp assembly 312 positioned at its upper end to which actuation arm 314 is attached. Tether line 116 is connected to actuation arm 314 and extends downwardly to BOP stack 104 as previously noted. Toggle clamp assembly 312 holds toggle retainer clamps 322 in engagement retaining annularly shaped flange 316 that seals inside the top of buoyancy tank or housing 310 with an annular seal ring 320.

Annularly shaped flange 316 is attached and sealed against riser section 108 by welds 318.

Rapidly removable section such as annularly shaped flange 316 is held by in sealing engagement with buoyancy tank or housing 310 by toggle retainer clamps 322. Toggle retainer clamps 322 include a frangible retainer pin 324. Frangible retainer pin 324 is sized to break when a suitable predetermined force is applied by tether line 116. Restraining line 326 extends between buoyancy tank or housing 310 and riser section 108 and connects to restraining hoops 328 that are welded to buoyancy tank 310 and riser section 108. As in the previous embodiments when a catastrophic riser failure occurs the ascent of positively buoyant riser sections 108 with attached buoyancy tank or housings 310 causes tether line 116 to be drawn taut and begins pulling on actuation arm 314. As best seen in FIG. 5, continued ascent of riser sections 108 with attached buoyancy tank or housings 310 causes frangible retainer pin 324 to break and toggle retainer clamps 322 to release annularly shaped flange 316 from buoyancy tank or housings 310. This detachment of annularly shaped flange 316 allows buoyancy tank or housing 310 to vent the compressed air therein and render riser sections 108 negatively buoyant. Restraining line 326 ensures that buoyancy tank or housing 310 does not completely separate from riser section 108 and thereby aids in salvage operations.

Figure 6:
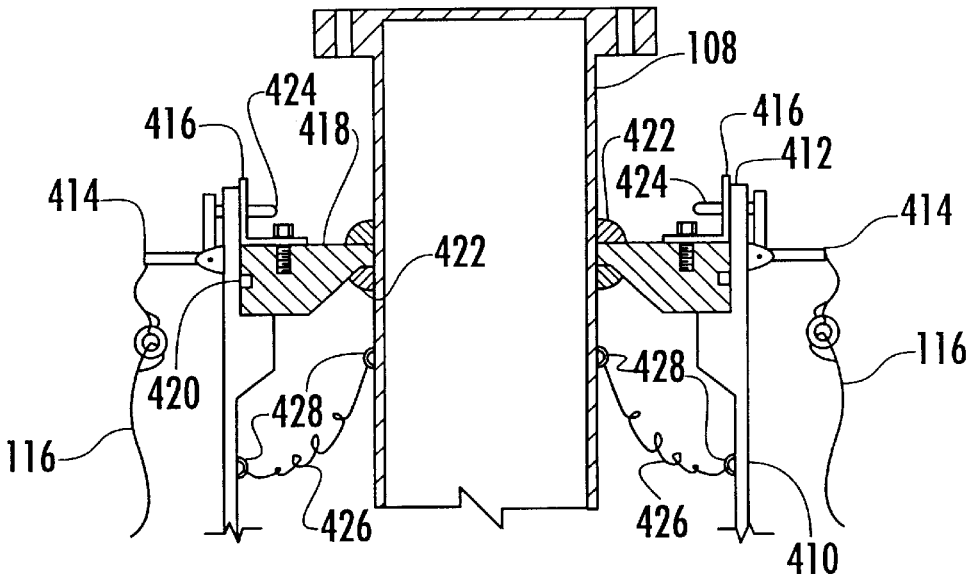
FIG. 6 is a sectional view of the third embodiment of the emergency dump apparatus prior to being activated.
Figure 7:
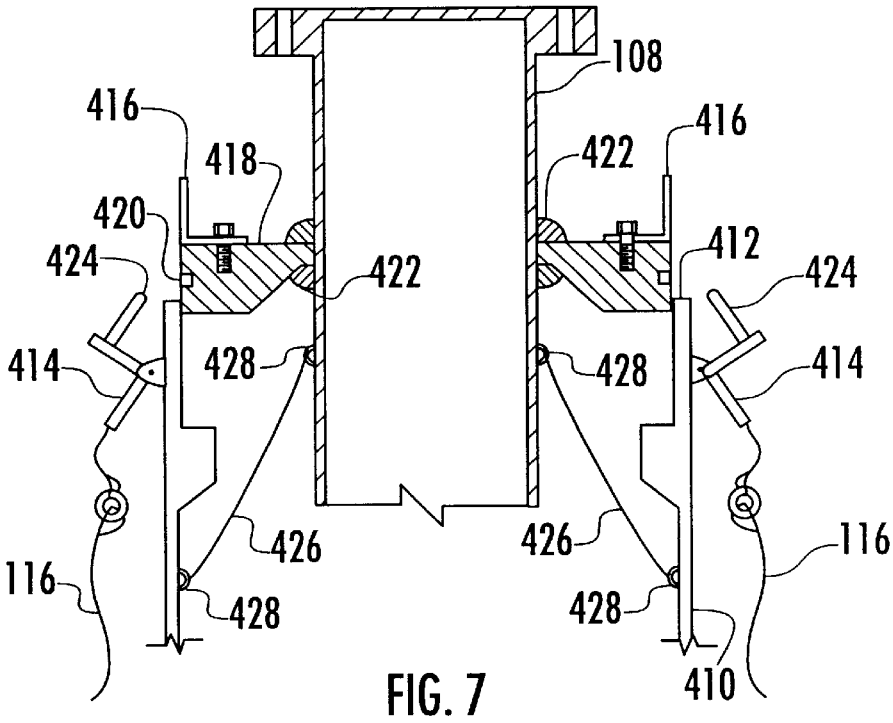
FIG. 7 is a sectional view of the third embodiment of the emergency dump apparatus after activation.

A third embodiment of the present invention is shown in FIGS. 6 and 7. Those items that are the same as in the first embodiment retain the same numeric designation. As in the first embodiment, riser section 108 has buoyancy tank or housing 410 attached thereto. Buoyancy tank or housing 410 has retainer pin assembly 412 positioned at its upper end to which actuation arm 414 is attached. Tether line 116 is connected to actuation arm 414 and extends downwardly to BOP stack 104 as previously noted. Retainer pin assembly 412 holds retainer arm 416 in engagement retaining annularly shaped flange 418 that seals inside the top of buoyancy tank or housing 410 with an annular seal ring 420. Rapidly removable section such as annularly shaped flange 418 is attached and sealed against riser section 108 by welds 422.

Annularly shaped flange 418 is held by in sealing engagement with buoyancy tank or housing 410 by retainer arm 416. Retainer arm 416 is held in position by retainer pin assembly 412 that includes removable retainer pin 424. Removable retainer pin 424 is released when a suitable predetermined force is applied by tether line 116 to actuation arm 414 and pivoting retainer pin assembly 412 outwardly. Restraining line 426 extends between buoyancy tank or housing 410 and riser section 108 and connects to restraining hoops 428 that are welded to buoyancy tank 410 and riser section 108. As in the previous embodiments when a catastrophic riser failure occurs the ascent of positively buoyant riser sections 108 with attached buoyancy tank or housings 410 causes tether line 116 to be drawn taut and begins pulling on actuation arm 414. As best seen in FIG. 7, continued ascent of riser sections 108 with attached buoyancy tank or housings 410 causes retainer pin assembly 412 to pivot outward and withdraw retainer pin 424 from retainer arm 416 to release annularly shaped flange 418 from buoyancy tank or housings 410. This detachment of annularly shaped flange 418 allows buoyancy tank or housing 410 to vent the compressed air therein and render riser sections 108 negatively buoyant. Restraining line 426 ensures that buoyancy tank or housing 410 does not completely separate from riser section 108 and thereby aids in salvage operations.

Figure 8:
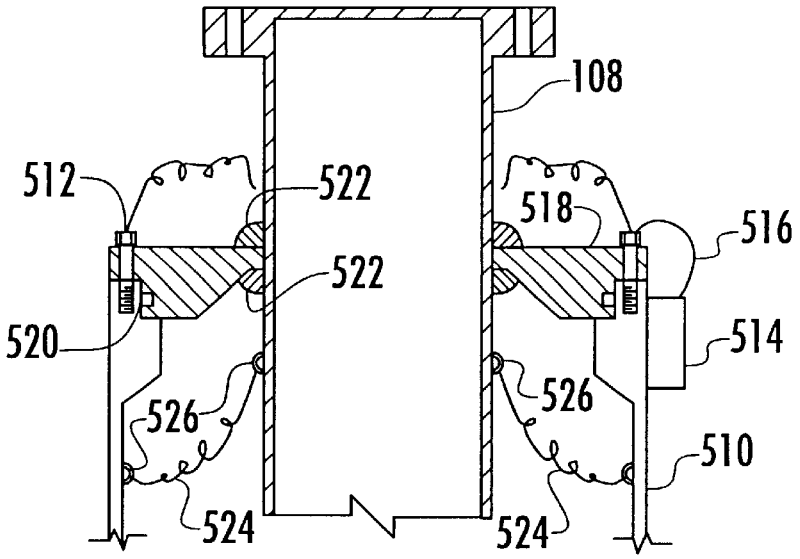
FIG. 8 is a sectional view of the fourth embodiment of the emergency dump apparatus prior to being activated.
Figure 9:
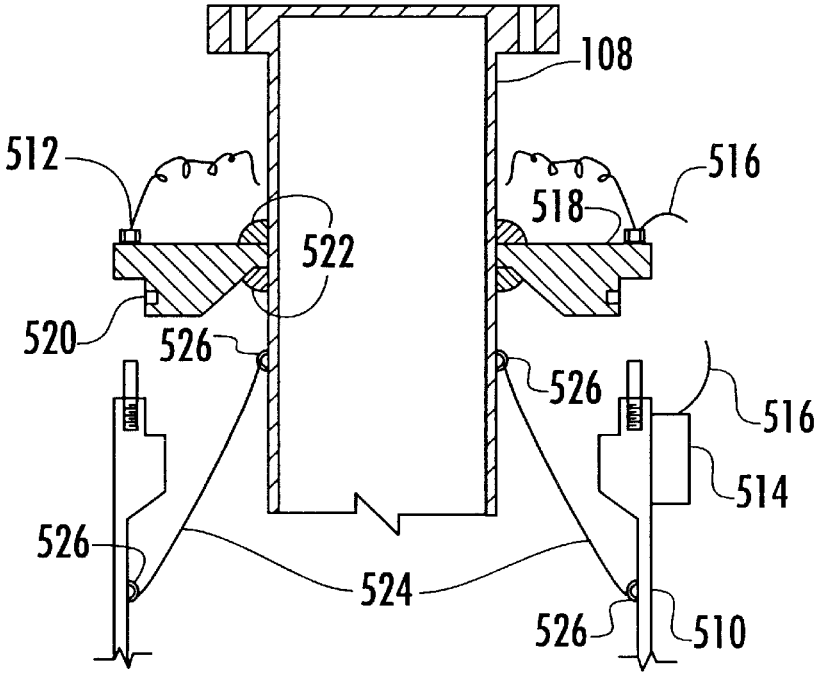
FIG. 9 is a sectional view of the fourth embodiment of the emergency dump apparatus after activation.

A fourth embodiment of the present invention is shown in FIGS. 8 and 9. Those items that are the same as in the first embodiment retain the same numeric designation. As in the first embodiment, riser section 108 has buoyancy tank or housing 510 attached thereto. Buoyancy tank or housing 510 has explosive bolt assembly 512 positioned at its upper end. A sensing means such as transceiver box 514 is attached to buoyancy tank or housing adjacent explosive bolt assembly 512. Control lead 516 connects transceiver box 514 to a remote releasing means such as explosive bolt assembly 512. Explosive bolt assembly 512 retains annularly shaped flange 518 that seals inside the top of buoyancy tank or housing 510 with an annular seal ring 520. Annularly shaped flange 518 is attached and sealed against riser section 108 by welds 522.

Rapidly removable section such as annularly shaped flange 518 is held in sealing engagement with buoyancy tank or housing 510 by explosive bolt assembly 512. Explosive bolt assembly 512 is activated when upon detection of a parting of the riser a signal is sent to a sensing means such as transceiver box 514. Such signal could be mechanical, electrical, acoustic or hydraulic without departing from the scope of the present invention. Restraining line 524 extends between buoyancy tank or housing 510 and riser section 108 and connects to restraining hoops 526 that are welded to buoyancy tank 510 and riser section 108. When a catastrophic riser failure occurs a signal is transmitted to transceiver box 514 that in turns fires explosive bolt assembly 512 through control lead 516. As best seen in FIG. 9, the release of explosive bolt assembly 512 allows annularly shaped flange 518 to be released from buoyancy tank or housings 510. This detachment of annularly shaped flange 518 allows buoyancy tank or housing 510 to vent the compressed air therein and render riser sections 108 negatively buoyant. Restraining line 524 ensures that buoyancy tank or housing 510 does not completely separate from riser section 108 and thereby aids in salvage operations.

My improved apparatus to provide for rapid venting of the compressed air and deballasting of a buoyant air tank in a positively buoyant riser system in the event of a riser section parting and the methods of its application will be readily understood from the foregoing description. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. An emergency dump apparatus for buoyancy tanks or housings on buoyant riser systems in a subsea environment, comprising:

a buoyancy housing positioned about a riser section, said buoyancy housing including a frangible section;

a plurality of restraining lines extending between said buoyancy housing and said riser section;

a sensing means;

a remote releasing means positioned on said frangible section of said buoyancy housing and controlled by said sensing means, said sensing means activating said remote releasing means upon a parting of said riser to detach said frangible section from said buoyancy housing and flood said buoyancy housing while said restraining lines limit movement of said buoyancy housing with respect to said riser section.

2. An emergency dump apparatus for buoyancy tank or housings used on buoyant riser systems in a subsea environment according to claim 1 wherein:

said frangible section of said buoyancy housing includes an annular flange sealing the annulus between said riser section and said buoyancy housing to maintain pressure within said buoyancy housing prior to detachment of said frangible section.

3. An emergency dump apparatus for buoyancy tank or housings used on buoyant riser systems in a subsea environment according to claim 2 wherein:

said sensing means is responsive to a parting of the riser.

4. An emergency dump apparatus for buoyancy tank or housings used on buoyant riser systems in a subsea environment according to claim 3 wherein:

said remote releasing means is an explosive bolt assembly.

* * * * *